US011970318B2

(12) United States Patent
James et al.

(10) Patent No.: US 11,970,318 B2
(45) Date of Patent: Apr. 30, 2024

(54) CONTAINERS WITH SELECTABLE PARTITIONS

(71) Applicant: WestRock Shared Services, LLC, Atlanta, GA (US)

(72) Inventors: Jeffrey S. James, Elmhurst, IL (US); Chad Rebmann, Maple Valley, WA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 17/520,433

(22) Filed: Nov. 5, 2021

(65) Prior Publication Data

US 2023/0002108 A1 Jan. 5, 2023

Related U.S. Application Data

(60) Provisional application No. 63/110,203, filed on Nov. 5, 2020.

(51) Int. Cl.
*B65D 5/48* (2006.01)
*B65D 5/496* (2006.01)

(52) U.S. Cl.
CPC ..... *B65D 5/48014* (2013.01); *B65D 5/4804* (2013.01)

(58) Field of Classification Search
CPC ..... B65D 5/48014; B65D 5/48018; B65D 5/48028; B65D 5/48042; B65D 5/48048; B65D 5/48024; B65D 5/48026; B65D 5/48036; B65D 5/48038
USPC ..... 229/120.06, 120.08, 120.09, 120.18, 229/120.24, 120.31, 120.26, 120.36, 229/120.38; 220/528; 206/747
See application file for complete search history.

(56) References Cited

U.S. PATENT DOCUMENTS 3,930,438 A * 1/1976 Hackman ..... B31B 50/81 493/379
4,335,842 A * 6/1982 Bradford ..... B65D 5/4804 229/120.24
4,376,507 A * 3/1983 Nauheimer ..... B65D 5/48024 229/120.24
4,376,508 A * 3/1983 Gardner ..... B65D 5/48008 229/120.24
4,379,518 A * 4/1983 Taylor, Sr. ..... B65D 5/4804 229/120.24

(Continued)

FOREIGN PATENT DOCUMENTS

EP 223623 A1 5/1987
GB 2159498 A * 12/1985 ..... B65D 5/48014

*Primary Examiner* — Christopher R Demeree
*Assistant Examiner* — Phillip D Schmidt
(74) *Attorney, Agent, or Firm* — Neil G. Cohen; Rohini K. Garg

(57) ABSTRACT

A container can include a plurality of side panels defining an interior space, and an inner partition member disposed at least partially within the interior space. The inner partition member can be configured to be at least partially conformal with the plurality of side panels in a first position, and to form one or more partitions dividing the interior space in at least a second position. In certain embodiments, only a portion of the inner partition member can be attached to an interior surface of the plurality of side panels such that the inner partition member can be configured to be moved between the first position and at least the second position.

20 Claims, 16 Drawing Sheets

(56) References Cited

U.S. PATENT DOCUMENTS

| | | | | |
|---|---|---|---|---|
| 4,470,539 | A * | 9/1984 | Skillen | B65D 5/48028 206/427 |
| 4,955,502 | A * | 9/1990 | Sorci | B65D 5/4804 229/120.24 |
| 5,624,032 | A * | 4/1997 | Yucknut | B65D 5/5059 229/120.32 |
| 5,967,406 | A * | 10/1999 | Moorman | B65D 5/324 206/427 |
| 6,874,679 | B2 | 4/2005 | Tibbles et al. | |
| 8,152,051 | B2 * | 4/2012 | Younger | B65D 5/48036 229/120.31 |
| 8,800,854 | B2 | 8/2014 | Chapman et al. | |
| 9,022,276 | B2 * | 5/2015 | Little | B65D 5/542 229/120.17 |
| 9,211,002 | B2 * | 12/2015 | Lo | A47B 43/02 |
| 10,322,844 | B2 | 6/2019 | Boersma et al. | |
| 10,322,845 | B2 | 6/2019 | Boersma et al. | |
| 2012/0080512 | A1 * | 4/2012 | Gray | B65D 5/2047 229/120.02 |

* cited by examiner

300B

CONTAINERS WITH SELECTABLE PARTITIONS

FIELD

This disclosure relates to containers having partitions.

BACKGROUND

Traditional containers include partitions that are separate structures that can be inserted. In some cases, no partition is desired which requires removal of the separate partition.

Such conventional methods and systems have generally been considered satisfactory for their intended purpose. However, there is still a need in the art for improved containers. The present disclosure provides a solution for this need.

SUMMARY

In accordance with at least one aspect of this disclosure, a container can include a plurality of side panels defining an interior space, and an inner partition member disposed at least partially within the interior space. The inner partition member can be configured to be at least partially conformal with the plurality of side panels in a first position, and to form one or more partitions dividing the interior space in at least a second position. In certain embodiments, only a portion of the inner partition member can be attached to an interior surface of the plurality of side panels such that the inner partition member can be configured to be moved between the first position and at least the second position.

The plurality of side panels can include at least a first side panel, a second side panel, a third side panel, and a fourth side panel foldably connected together at vertical side fold lines. In certain embodiments, the plurality of side panels can include only the first, second, third, and fourth side panels, wherein the first side panel is connected to the fourth side panel to form a box.

The inner partition member can include a plurality of partition panels foldably connected together at vertical partition fold lines. The plurality of inner partition panels can include an odd number of partition panels. For example, the middle panel can be connected to the inner surface of one of the side panels.

In certain embodiments, the inner partition member can include a first, second, third, fourth, fifth, sixth, and seventh partition panels. In certain embodiments, the partition panels can be equally sized and shaped.

The first and third side panels can be sized to be the about the same length as three partition panels. The second and fourth side panels can be sized such that two partition panels are configured to extend across the interior space from the third side panel to the first side panel.

In certain embodiments, the fourth partition panel can be adhered to a middle of the interior surface of the third side panel or second side panel such that the first, second, third, fifth, sixth, and seventh partition panels can be configured to move relative to the fourth partition panel and the third side panel or second side panel. In certain embodiments, the second position can be a partially partitioned position. For example, the third partition panel and the second partition panel can be folded relative to the fourth partition panel to extend across the interior space such that the first panel can be in flush contact with the opposing side wall, or the fifth partition panel and the sixth partition panel can be folded relative to the fourth partition panel to extend across the interior space such that the seventh panel can be in flush contact with the opposing side wall.

In certain embodiments, the second position can be a fully partitioned position wherein the third partition panel and the second partition panel can be folded relative to the fourth partition panel to extend across the interior space such that the first panel can be in flush contact with the opposing side wall, and the fifth partition panel and the sixth partition panel can be folded relative to the fourth partition panel to extend across the interior space such that the seventh panel can be in flush contact with the opposing side wall.

In certain embodiments, the partition panels can be about the same height as the side panels. In certain embodiments, the partition panels can be less than the height of the side panels (e.g., half size).

The container can include a plurality of bottom panels configured to form a bottom, each foldably connected to a bottom of a respective side panel. In certain embodiments, in the second position, the partition panels that extend across the interior space can be configured to align with and/or interact with an edge of one or more bottom panels to provide a lateral support to the partition panels to at least partially retain the partition panels in the second position.

In certain embodiments, the container can include one or more top panels configured to form a top enclosure, each foldably connected to a top of a respective side panel. Any other suitable panels are contemplated herein.

In accordance with at least one aspect of this disclosure, a blank arrangement can be configured to form any suitable package as disclosed herein, e.g., as described above. In certain embodiments, a blank arraignment can include a first blank having a plurality of side panels foldably connected together and configured to define an interior space, and a second blank comprising a plurality of partition panels foldably connected together. In certain embodiments, only a single partition panel may be adhered to an attachment panel of the plurality of side panels.

In certain embodiments, only a middle panel or plurality of middle panels of the plurality of partition panels are adhered to attachment panel. Any other suitable arrangement is contemplated herein.

In certain embodiments, the plurality of side panels includes a first, second, third, and fourth side panel. The plurality of partition panels can include a first, second, third, fourth, fifth, sixth, and seventh partition panel. The fourth partition panel can be adhered to a middle of the third side panel such that there are an equal number of moveable partition panels on each side of the fourth side panel.

In certain embodiments, the second blank can lay completely within edges of the first blank. For example, in certain embodiments, the second blank can extend over only the second, third, and fourth side panels.

In certain embodiments, the partition panels can be equally sized and shaped. In certain embodiments, the first and third side panels can be sized to be the about the same length as three partition panels, and the second and fourth side panels can be sized such that two partition panels are configured to extend across the interior space from the third side panel to the first side panel.

In certain embodiments, the partition panels can be about the same height as the side panels. In certain embodiments, the partition panels can be less than the height of the side panels.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
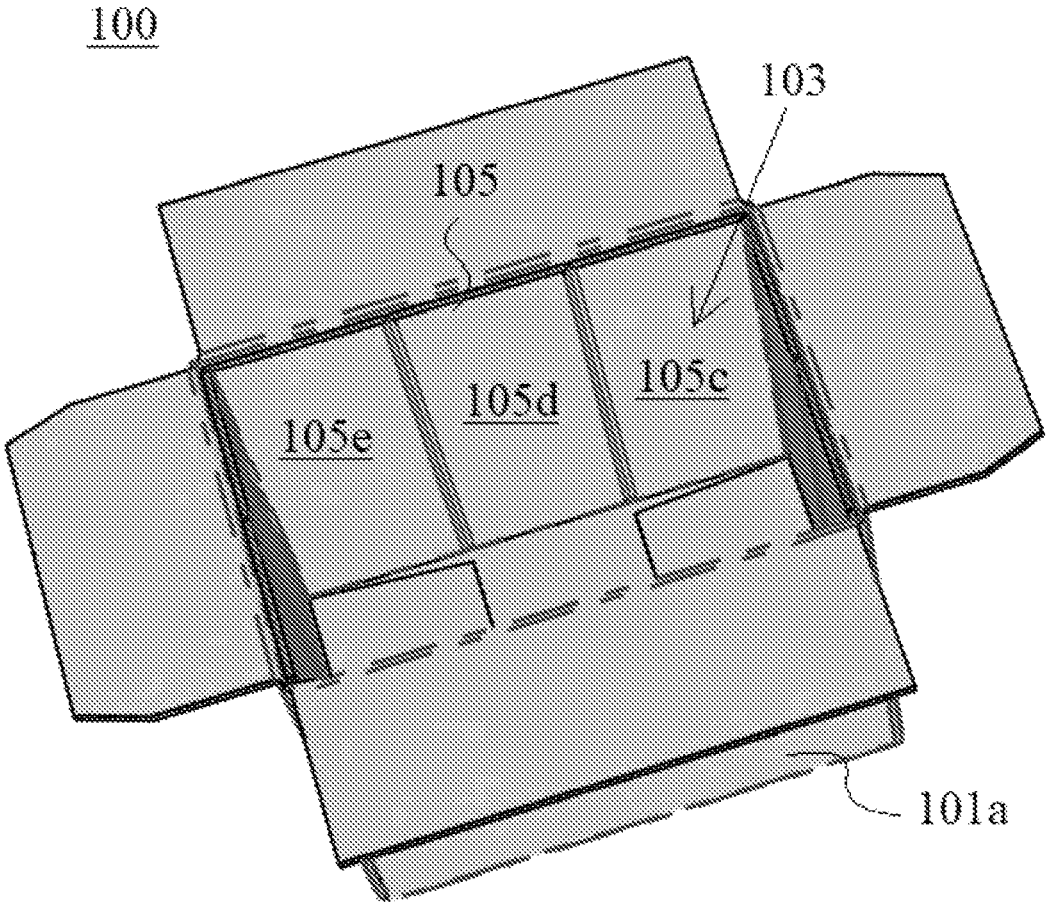
FIGS. 1A and 1B show a first perspective view and a second perspective view of an embodiment of a container in accordance with this disclosure, shown having an inner partition member in a first position.
Figure 1B:
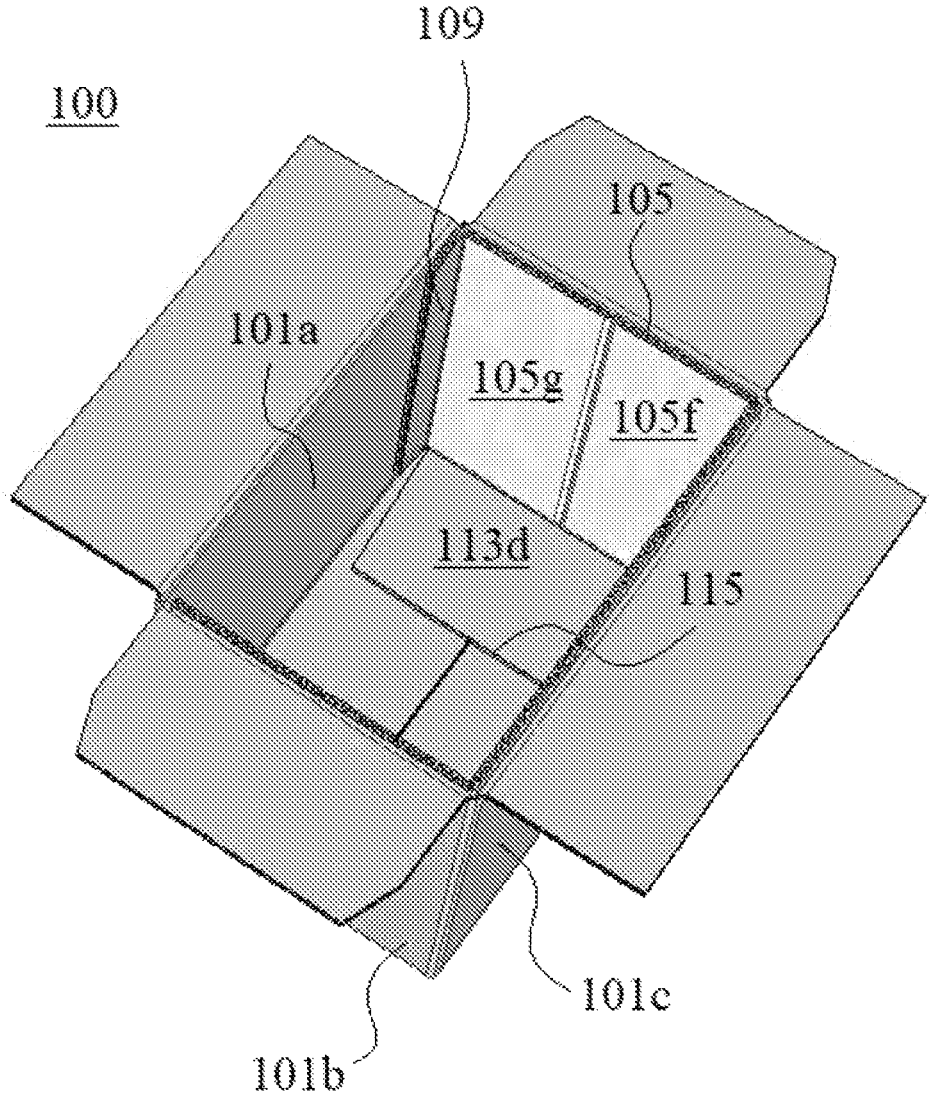
Figure 1C:
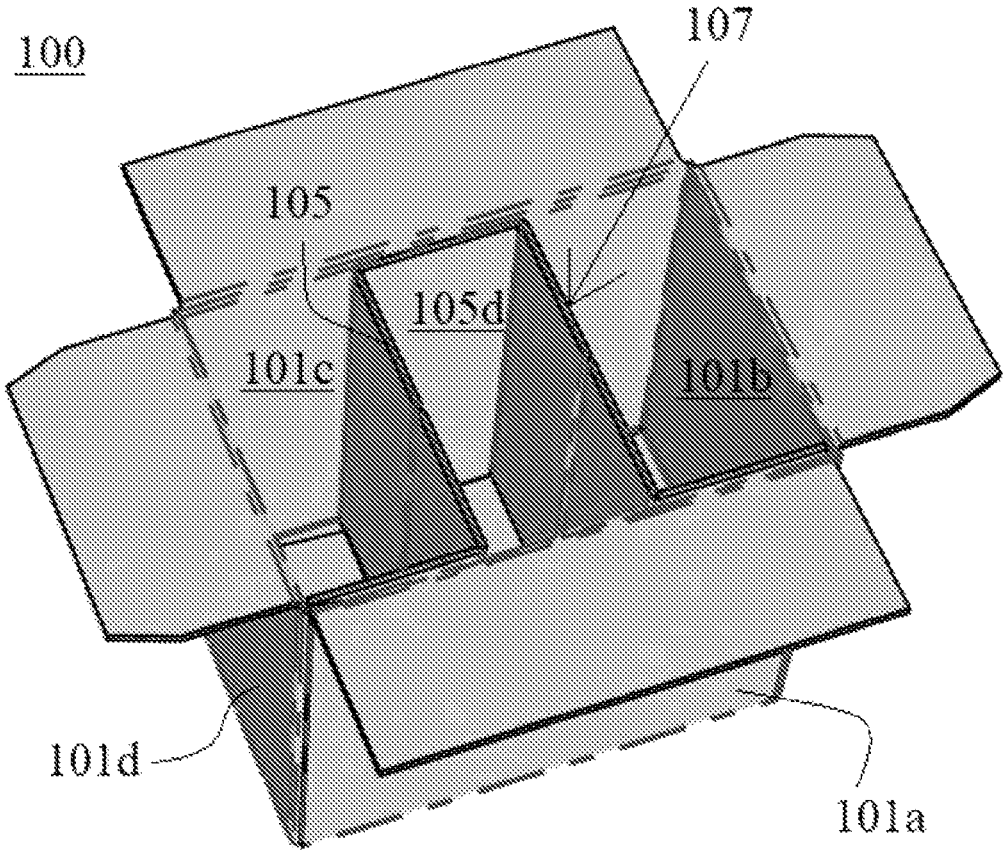
FIGS. 1C and 1D show a first perspective view and a second perspective view of the embodiment of FIGS. 1A and 1B, shown with the inner partition member in a second position.
Figure 1D:
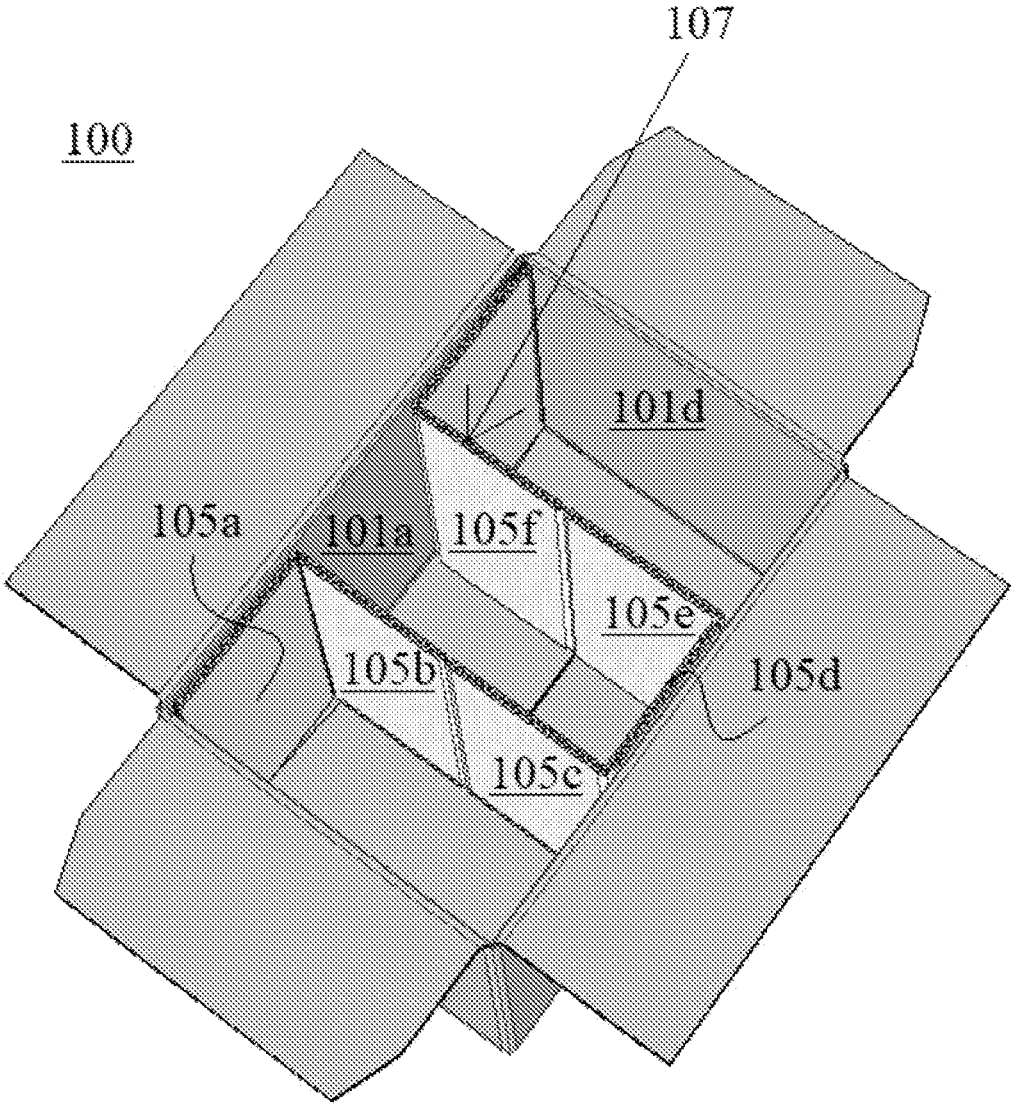
Figure 2A:
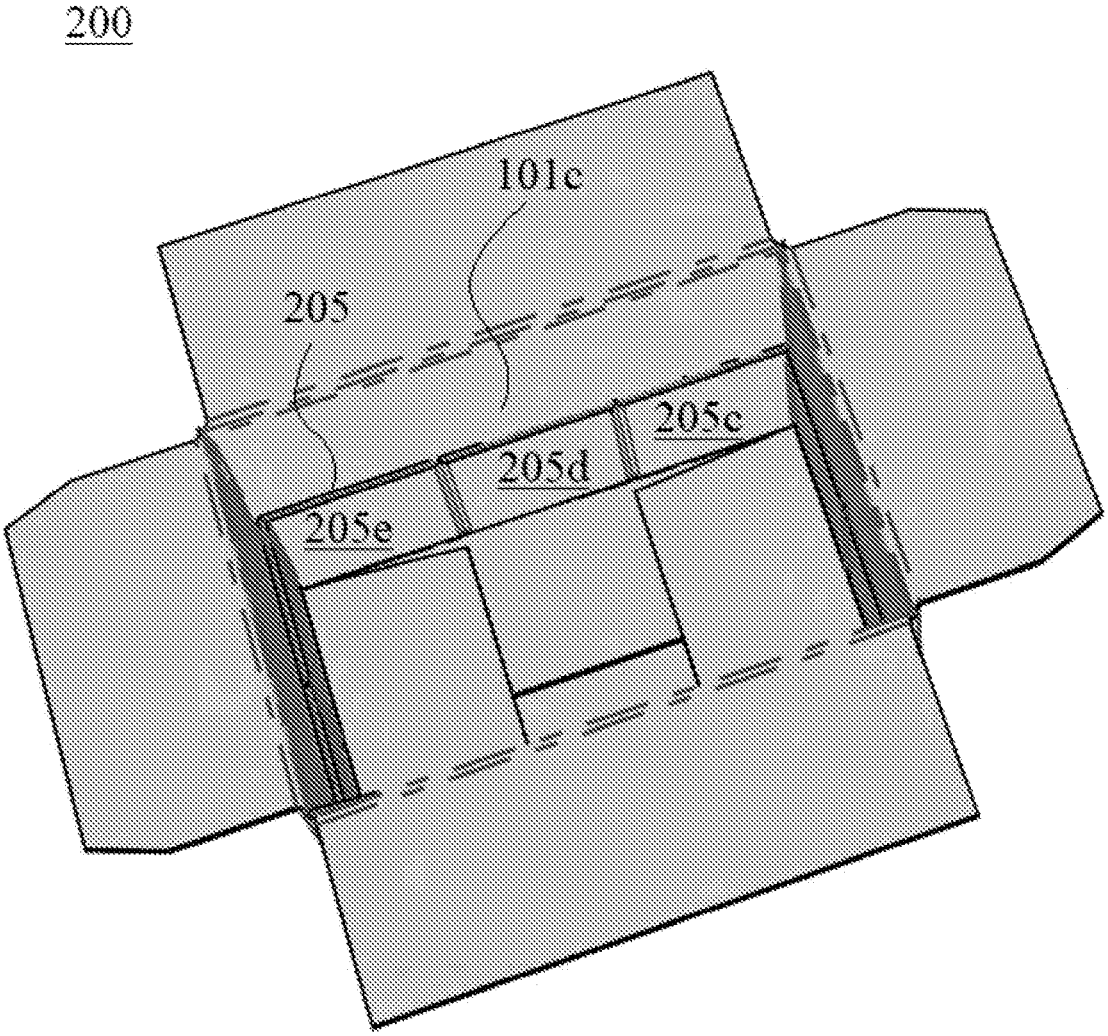
FIGS. 2A and 2B show a first perspective view and a second perspective view of an embodiment of a container in accordance with this disclosure, shown having an inner partition member in a first position.
Figure 2B:
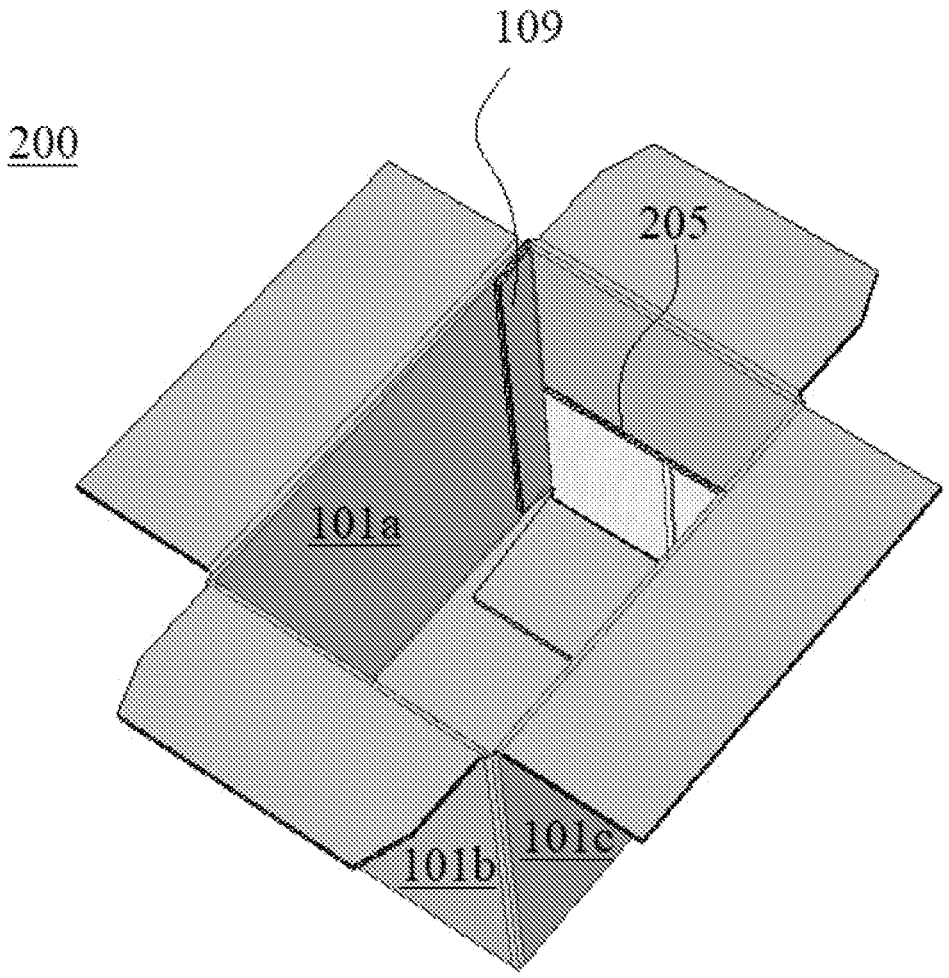
Figure 2C:
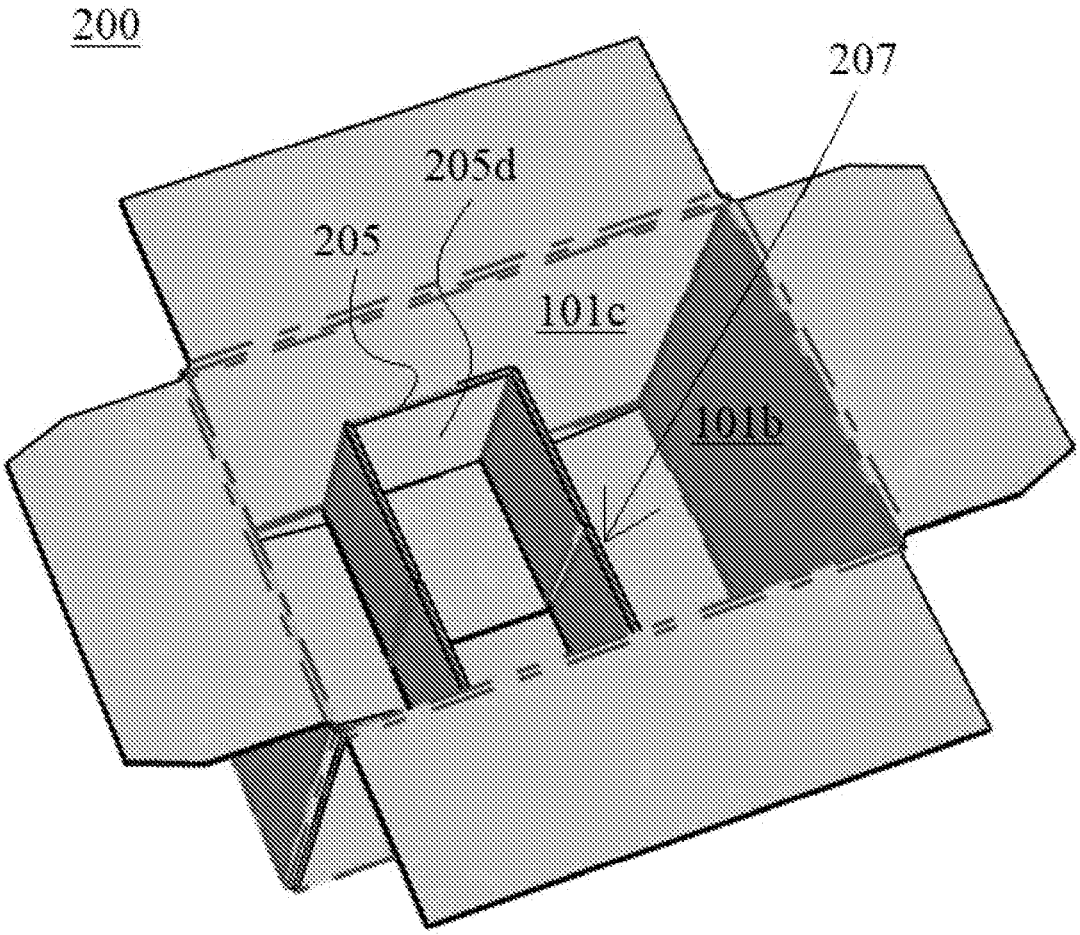
FIGS. 2C and 2D show a first perspective view and a second perspective view of the embodiment of FIGS. 2A and 2B, shown having the inner partition member in a second position.
Figure 2D:
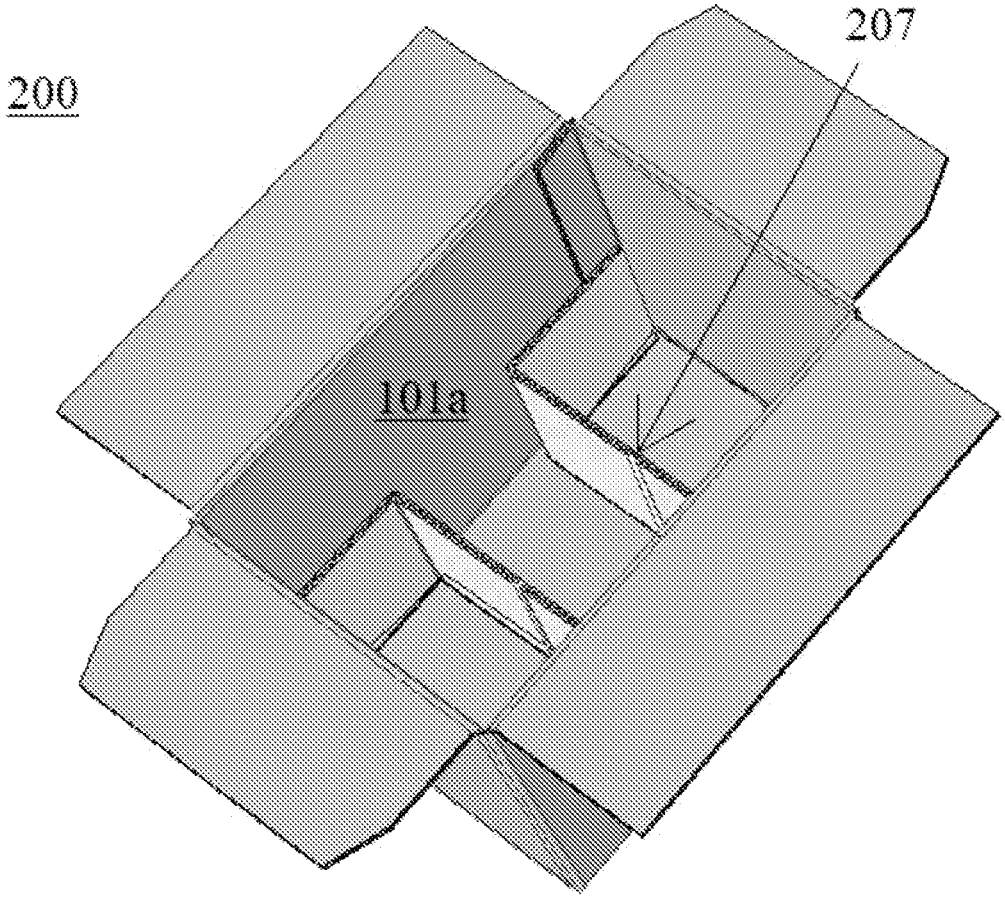

Reference will now be made to the drawings wherein like reference numerals identify similar structural features or aspects of the subject disclosure. For purposes of explanation and illustration, and not limitation, an illustrative view of an embodiment of a container in accordance with the disclosure is shown in FIGS. 1A and is designated generally by reference character 100. Other embodiments and/or aspects of this disclosure are shown in FIGS. 1B-6. Certain embodiments described herein can be used to provide containers (e.g., packages) having integrated and selectable partitions.

Referring to FIGS. 1A-2D, a container 100, 200 can include a plurality of side panels 101*a, b, c, d* defining an interior space 103. The container 100, 200 can include an inner partition member 105, 205 disposed at least partially within (e.g., entirely within as shown) the interior space 103. The inner partition member 105, 205 can be configured to be at least partially conformal (e.g., completely flush with) with the plurality of side panels 101*a, b, c, d* in a first position (e.g., as shown in FIGS. 1A, 1B, 2A, and 2B), and to form one or more partitions 107, 207 (e.g., two partitions as shown) dividing the interior space 103 in at least a second position (FIGS. 1C, 1D, 2C, 2D). Any suitable number of partitions 107, 207 to divide the interior space 103 into any suitable number of compartments or divisions is contemplated herein.

In certain embodiments, only a portion (e.g., a single panel, e.g., a middle panel as shown) of the inner partition member 105, 205 can be attached to an interior surface of the plurality of side panels 101*a, b, c, d* such that the inner partition member 105, 205 can be configured to be moved between the first position and at least the second position (e.g., by folding one or more partition panels relative to the single attached panel).

Figure 3A:
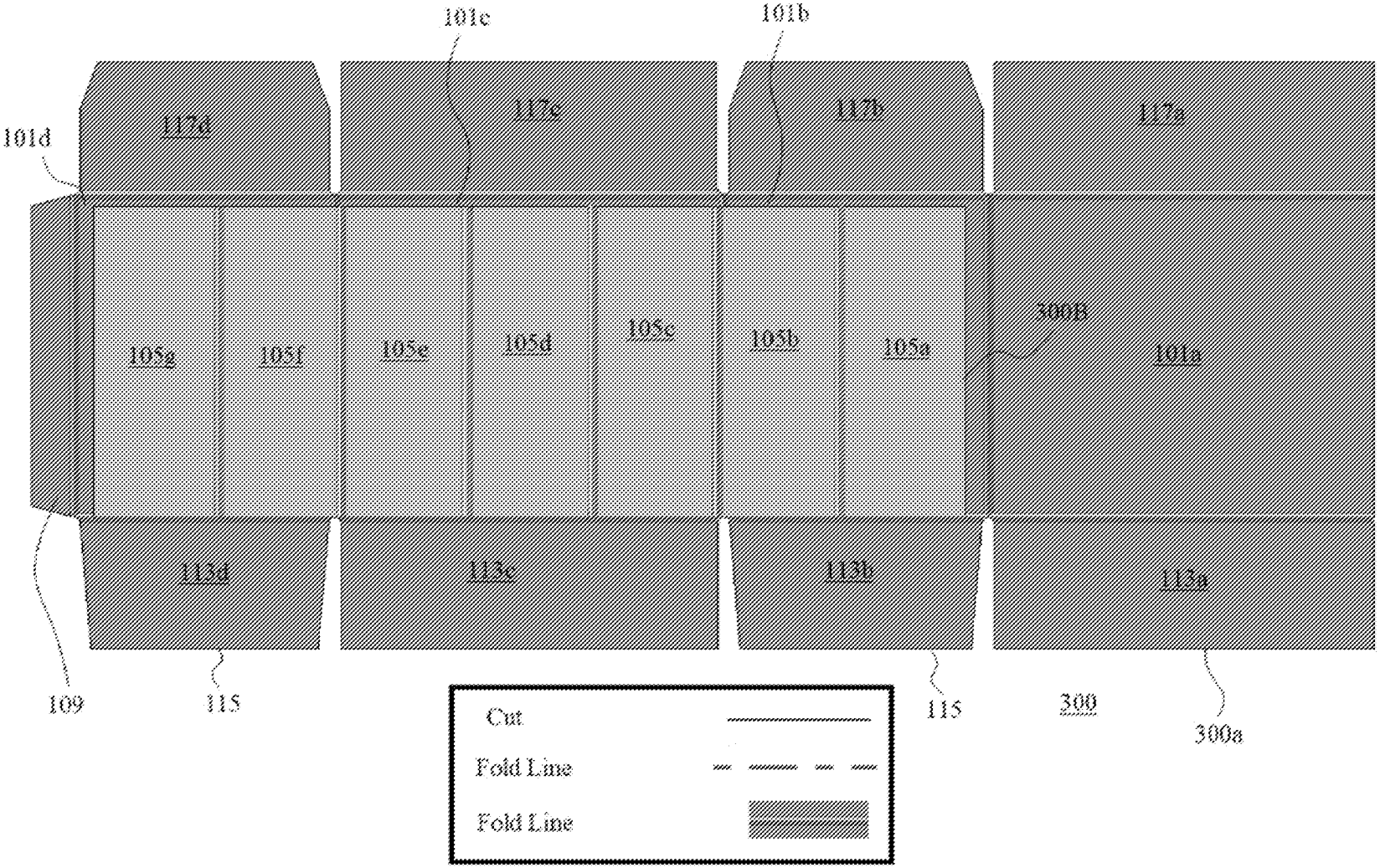
FIG. 3A shows a schematic view of an embodiment of a blank arrangement in accordance with this disclosure, showing an embodiment of a first blank having an embodiment of a second blank attached thereto.
Figure 3B:
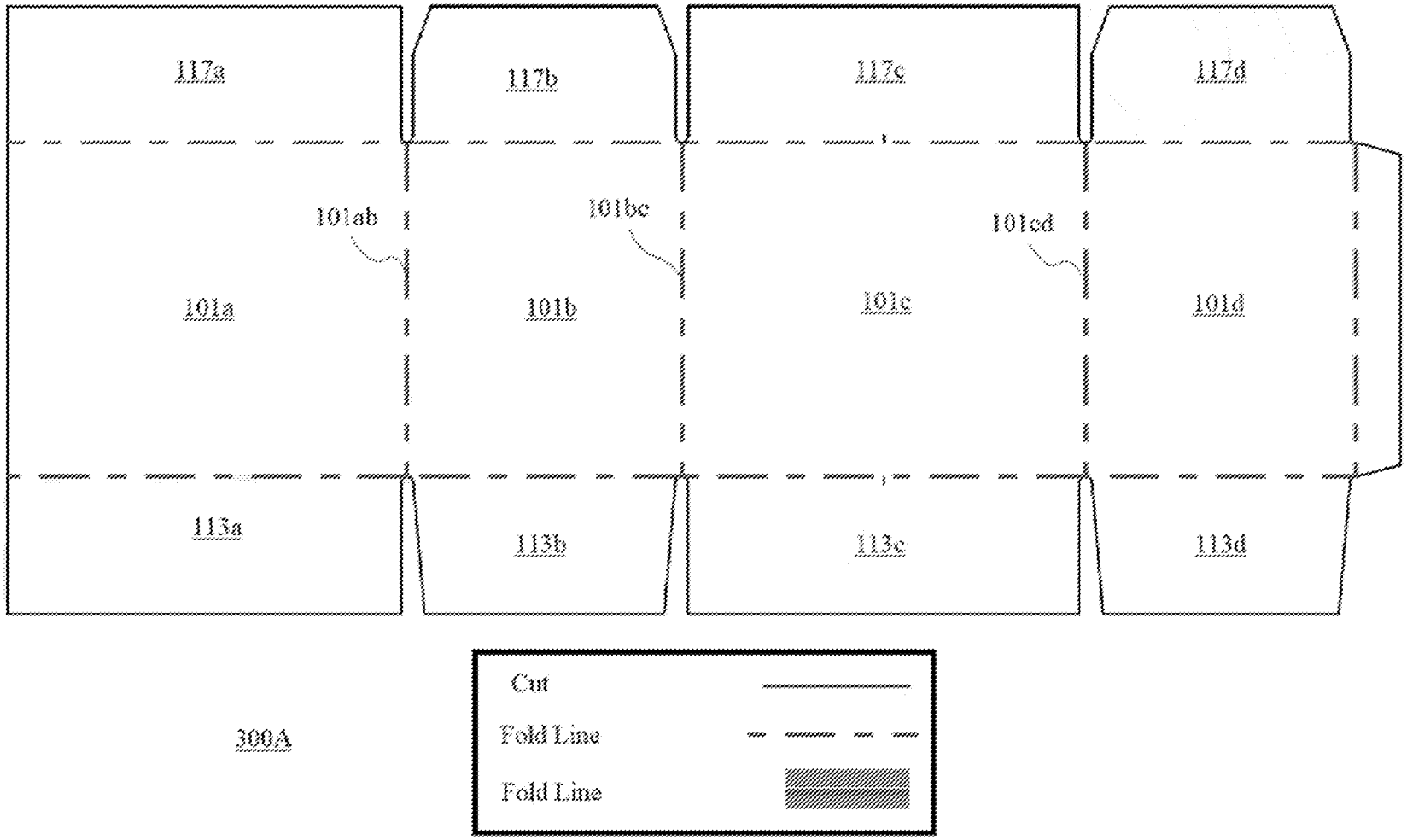
FIG. 3B shows a schematic view of the embodiment of a first blank shown in FIG. 3A.
Figure 3C:
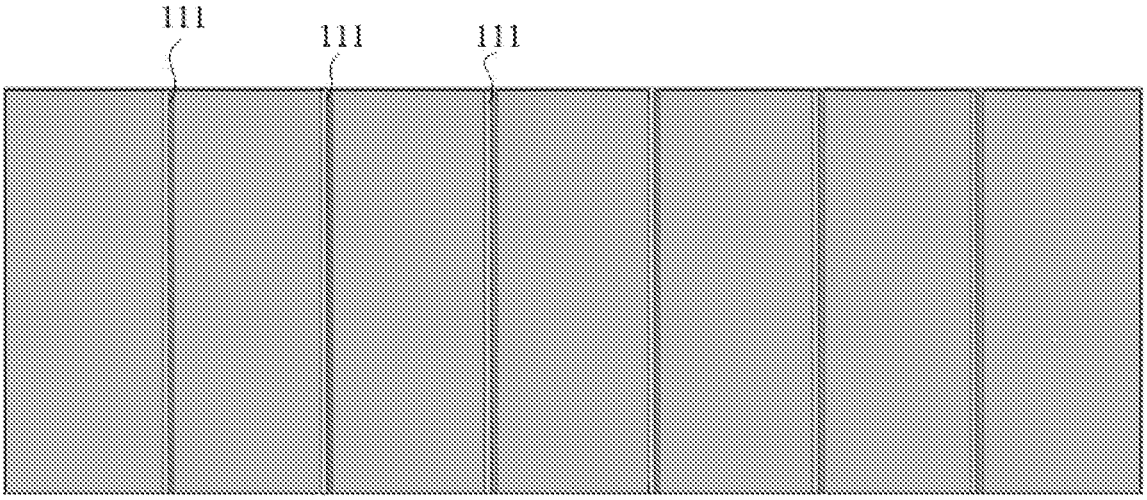
FIG. 3C shows a schematic view of the embodiment of a second blank shown in FIG. 3A.
Figure 3C:
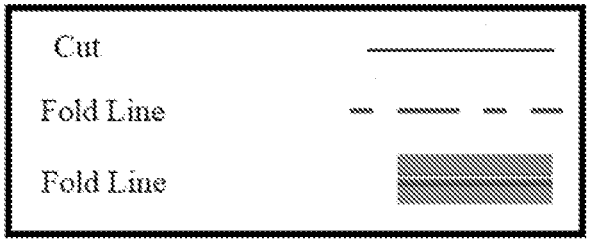
Figure 4A:
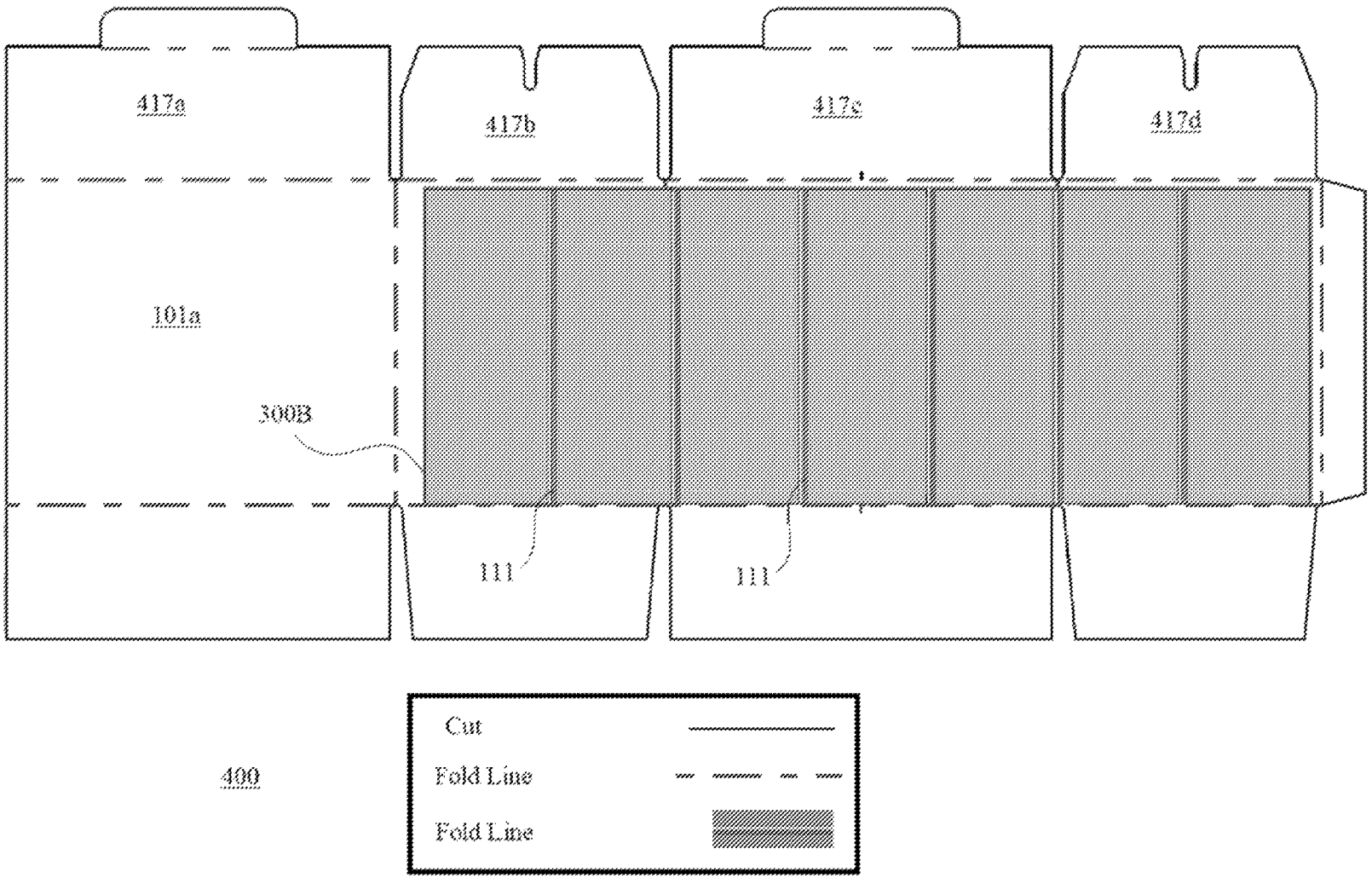
FIG. 4A shows a schematic view of an embodiment of a blank arrangement in accordance with this disclosure, showing another embodiment of a first blank having the embodiment of a second blank as shown in FIGS. 3A and 3C attached thereto.

The plurality of side panels 101*a, b, c, d* can include at least a first side panel 101*a*, a second side panel 101*b*, a third side panel 101*c*, and a fourth side panel 101*d* foldably connected together at vertical side fold lines 101*ab*, 101*bc*, 101*cd* (e.g., as shown in FIG. 4). While certain embodiments, e.g., as shown in FIGS. 1A-3 show a first panel 101*a* on the right hand side of the page when looking at an interior surface, it is contemplated the order can be reversed (e.g., mirror image as shown in FIGS. 4A-5B), and/or any other suitable order is contemplated herein.

In certain embodiments, the plurality of side panels 101*a, b, c, d* can include only the first, second, third, and fourth side panels as shown wherein the first side panel 101*a* can be connected to the fourth side panel 101*d* (e.g., via a connector tab 109) to form a box, e.g., having four sides as shown. Any suitable number of panels and/or fold lines to form any suitable shape (e.g., four sides to form a four sided box as shown) is contemplated herein.

The inner partition member 105, 205 can include a plurality of partition panels 105*a, b, c, d, e, f, g*, 205*a, b, c, d, e, f, g* foldably connected together at vertical partition fold lines 111, 211. The plurality of inner partition panels 105*a-g*, 205*a-g* can include an odd number of partition panels 105*a-g*, 205*a-g*. For example, the middle panel 105*d*, 205*d* can be connected to the inner surface of one of the side panels (e.g., side panel 101*c*). This can provide for a symmetric division, for example. Any other suitable arrangement is contemplated herein.

In certain embodiments, the inner partition member can include a first, second, third, fourth, fifth, sixth, and seventh partition panels 105*a-g*, 205*a-g* (e.g., only seven panels). Any other suitable number of panels are contemplated herein. In certain embodiments, the partition panels 105*a-g*, 205*a-g* can be equally sized and shaped, e.g., as shown. Any other suitable size and/or shape partition panels are contemplated herein.

Referring additionally to FIGS. 3A-3C, the first and third side panels 101*a*, 101*c* can be sized to be the about the same length as three partition panels 105*c*, 105*d*, 105*e*, for example. The second and fourth side panels 101*b*, 101*d* can be sized such that two partition panels (e.g., pair 1051*a*, 105*b*, pair 105*f*, 105*g*) are configured to extend across the interior space 103 from the third side panel 101*c* to the first side panel 101*a*.

In certain embodiments, the fourth partition panel 105*d* can be adhered to a middle (e.g., as shown) of the interior surface of the third side panel 101*c* or second side panel (e.g., 101*b*) such that the first, second, third, fifth, sixth, and seventh partition panels can be configured to move relative to the fourth partition panel 105*d* and the third side panel 101*c* or second side panel 101*b* (e.g., and/or fourth side panel 101*d*).

In certain embodiments, the second position can be a partially partitioned position (e.g., where the only one pair of partition panels is extending across the interior space 103). For example, the third partition panel 105*c* and the second partition panel 105*b* can be folded relative to the fourth partition panel 105*d* to extend across the interior space 103 such that the first panel 105*a* can be in flush contact with the opposing side wall (e.g., first side panel 101*a*), or the fifth partition panel 105*e* and the sixth partition panel 105*f* can be folded relative to the fourth partition panel 105*d* to extend across the interior space 103 such that the seventh panel 105*g* can be in flush contact with the opposing side wall (e.g., side panel 101*a*).

In certain embodiments, the second position can be a fully partitioned position (e.g., as shown in FIGS. 1C, 1D, 2C, 2D) wherein the third partition panel and the second partition panel can be folded relative to the fourth partition panel to extend across the interior space such that the first panel can be in flush contact with the opposing side wall, and the fifth partition panel and the sixth partition panel can be folded relative to the fourth partition panel to extend across the interior space such that the seventh panel can be in flush contact with the opposing side wall.

In certain embodiments, the partition panels 101*a-g* can be about the same height as the side panels. In certain embodiments, the partition panels 201*a-g* can be less than the height of the side panels (e.g., half size). Any suitable height is contemplated herein.

The container 100, 200 can include a plurality of bottom panels 113*a, b, c, d* configured to form a bottom, each foldably connected to a bottom of a respective side panel 101*a, b, c, d*. In certain embodiments, in the second position, the partition panels that extend across the interior space 103 can be configured to align with and/or interact with an edge 115 of one or more bottom panels 113*a, b, c, d* to provide a lateral support to the partition panels to at least partially retain the partition panels in the second position.

Figure 4B:
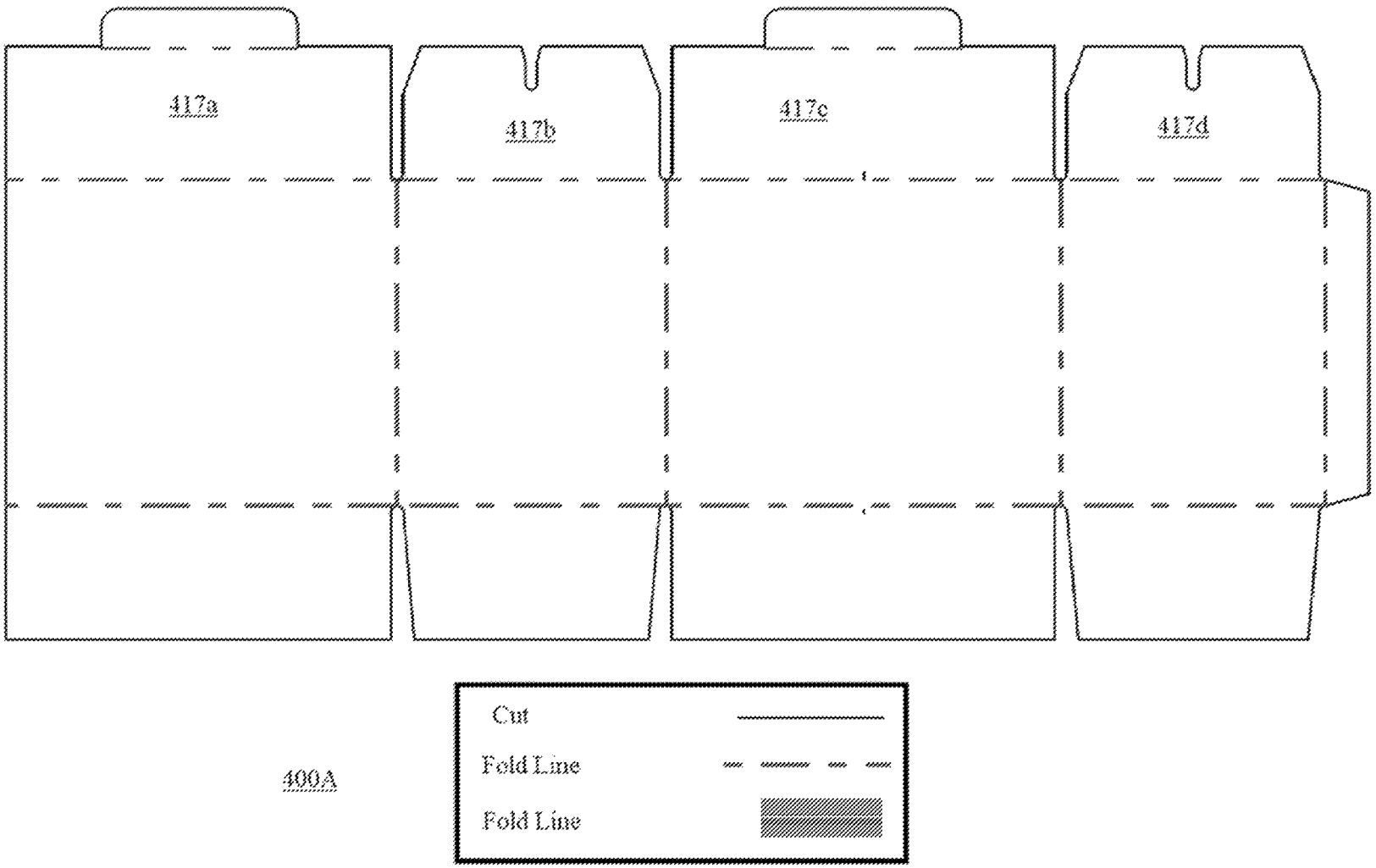
FIG. 4B shows a schematic view of the embodiment of a first blank shown in FIG. 4A.

In certain embodiments, the container 100, 200 can include one or more top panels 117*a, b, c, d*, configured to form a top enclosure, each foldably connected to a top of a respective side panel 101*a, b, c, d*. As shown, panels 117*a, b, c, d* can be configured to be attached with tape, glue, or any other suitable attachment. In certain embodiments, e.g., as shown in FIGS. 4A and 4B, the one or more top panels 417*a, b, c, d* can include one or more additional tabs or cutouts configured to provide a mechanical enclosure as appreciated by those having ordinary skill in the art. Any other suitable panels for any suitable purpose are contemplated herein.

Referring to FIGS. 3A-5B, in accordance with at least one aspect of this disclosure, a blank arrangement 300, 400, 500 can be configured to form any suitable package (e.g., 100, 200) as disclosed herein, e.g., as described above. In certain embodiments, a blank arraignment 300, 400, 500 can include a first blank 300A, 400A, having a plurality of side panels, e.g., 101*a, b, c, d* as described above, foldably connected together and configured to define an interior space. The blank arrangement 300, 400, 500 can include a second blank 300B, 500B (e.g., forming an inner partition member disclosed above) comprising a plurality of partition panels foldably connected together. In certain embodiments, only a single partition panel (e.g., panel 105*d*) may be adhered to an attachment panel (e.g., a middle a third side panel 101*c*) of the plurality of side panels. In certain embodiments, the second blank can include a slot, e.g., as shown in FIG. 6, defined along a fold line of the second blank (which is forming the partition in FIG. 6).

In certain embodiments, only a middle panel (e.g., panel 105*d*) or plurality of middle panels of the plurality of partition panels may be adhered to the attachment panel. Any other suitable arrangement is contemplated herein.

In certain embodiments, the plurality of side panels includes a first, second, third, and fourth side panel. The plurality of partition panels can include a first, second, third, fourth, fifth, sixth, and seventh partition panel. The fourth partition panel can be adhered to a middle of the third side panel such that there are an equal number of moveable partition panels on each side of the fourth side panel.

Figure 5A:
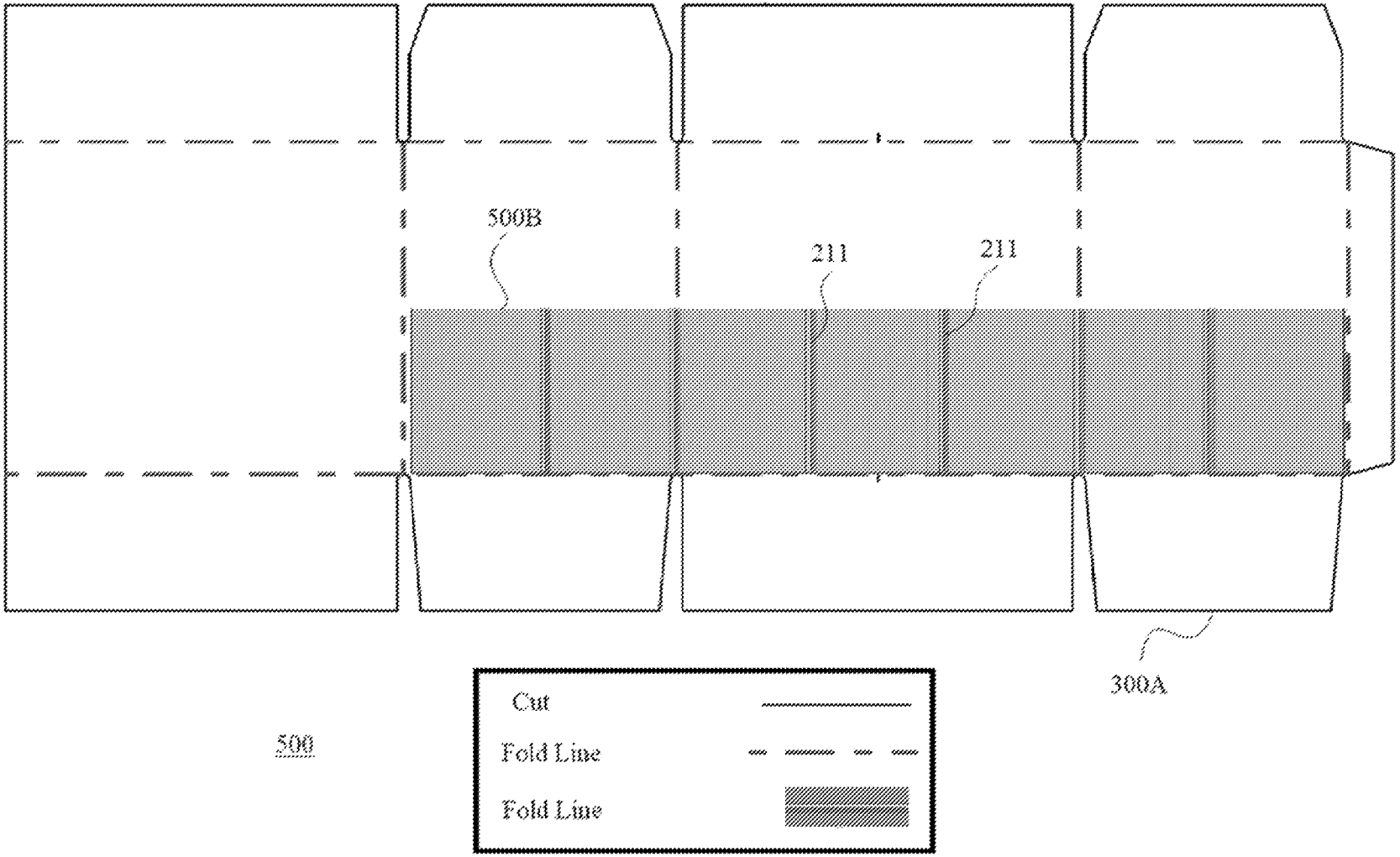
FIG. 5A shows a schematic view of an embodiment of a blank arrangement in accordance with this disclosure, showing the embodiment of a first blank of FIGS. 3A and 3B having another embodiment of a second blank attached thereto.
Figure 5B:
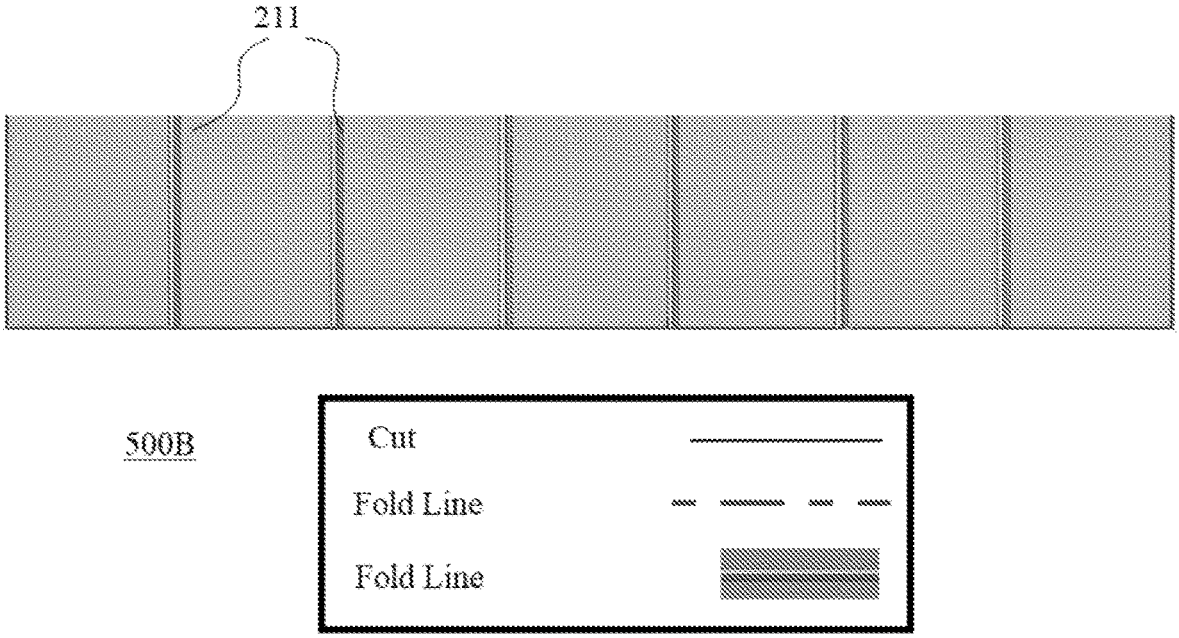
FIG. 5B shows a schematic view of the embodiment of a second blank shown in FIG. 5A.
Figure 6:
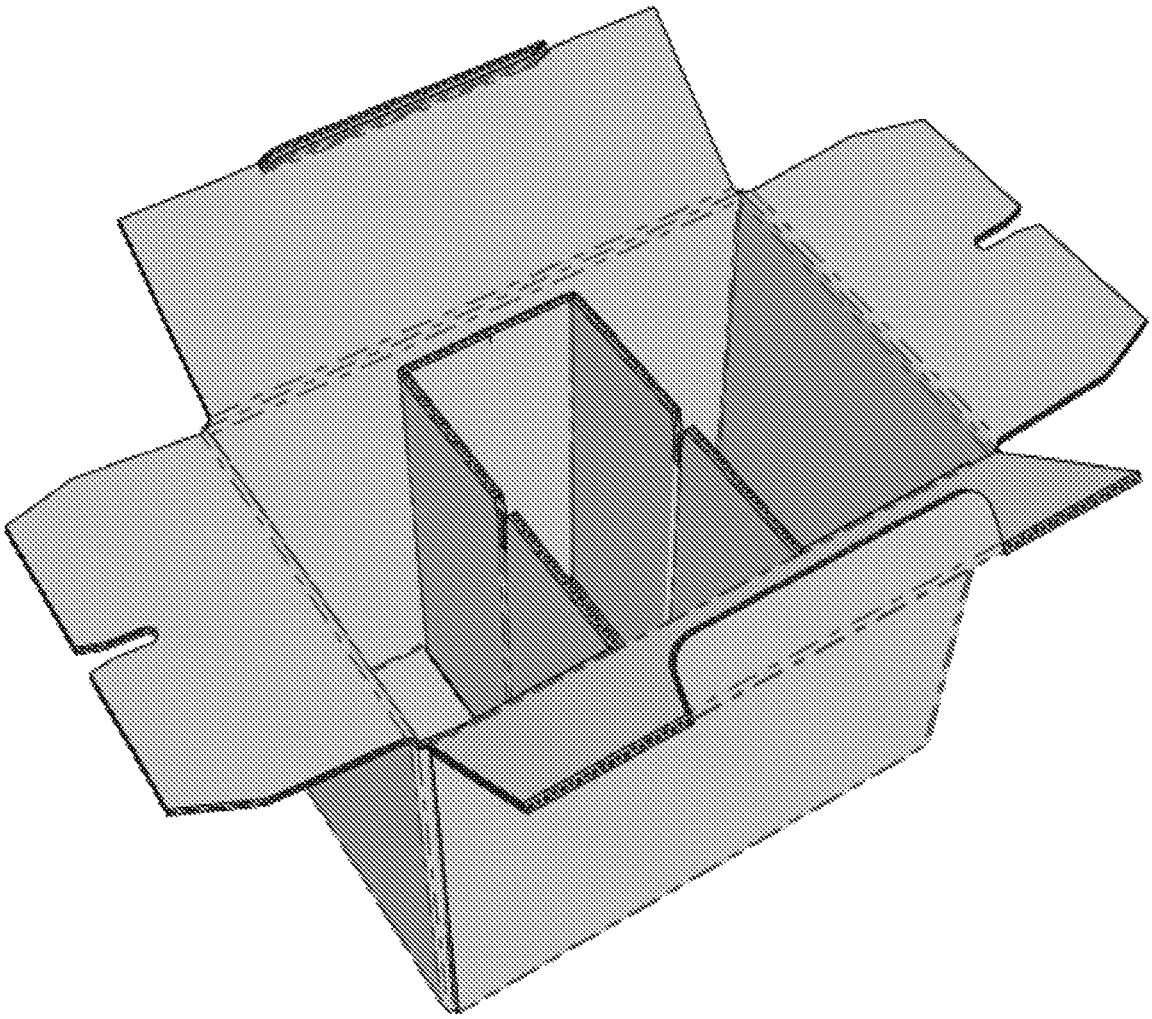
FIG. 6 is a perspective view of an embodiment of a container showing an embodiment of a second blank in accordance with this disclosure.

In certain embodiments, as shown in FIGS. 3A, 4A, and 5A the second blank 300B, 500B can lay completely within edges of the first blank 300A, 400A. For example, in certain embodiments, the second blank 300B, 500B can extend over only the second, third, and fourth side panels 101*b, c, d* as shown.

In certain embodiments, the partition panels can be equally sized and shaped. In certain embodiments, the first and third side panels can be sized to be the about the same length as three partition panels, and the second and fourth side panels can be sized such that two partition panels are configured to extend across the interior space from the third side panel to the first side panel.

In certain embodiments, the partition panels can be about the same height as the side panels. In certain embodiments, the partition panels can be less than the height of the side panels.

As appreciated by those having ordinary skill in the art in view of this disclosure, it is contemplated that, in certain embodiments, fold lines of the inner partition panel can align with edges of bottom minor flaps such that when folded over, the minor flaps lock the partition in position. Any suitable relative arrangement is contemplated herein.

Embodiments include a shipping case that has built in dividers that can be manipulated as needed into multiple cells. Embodiments can have a partition member/second blank can be glued to a first blank in on a suitable machine (e.g., a Meta® Duo machine sold by Westrock, Inc.). The partition member cab be or otherwise adhered, and can be available when needed, and conformal within the package when not needed to maximize the interior space. Certain embodiments can provide the ability to be divided into three cells, two cells, or left unpartitioned and not have the interior space divided at all. Embodiments can also provide additional vertical T-B support.

Any suitable adhesive can be applied to any suitable panel disclosed herein for any suitable purpose. Any suitable foldable line types are contemplated herein (e.g., perforated, creased, cut/creased, etc.). While the figures may include a legend indicating the line types of the embodiments of the figures, any other suitable line types for the lines shown in the drawings are contemplated herein. Any other suitable panel arrangement (e.g., more or less panels in any suitable location) is contemplated herein.

While embodiments have been described and shown above, any suitable panels and/or other design for a blank to form a package as disclosed above is contemplated herein. Any suitable material for use (e.g., paper, cardboard, plastic board, etc.) and/or one or more combinations thereof are contemplated herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of".

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A container, comprising:

a plurality of side panels defining an interior space; and an inner partition member disposed at least partially within the interior space, wherein the inner partition member is configured to be at least partially conformal with the plurality of side panels in a first position, and to form one or more partitions dividing the interior space in at least a second position, wherein only a portion of the inner partition member is attached to an interior surface of the plurality of side panels such that the inner partition member is configured to be moved between the first position and at least the second position, wherein the inner partition member includes a plurality of partition panels, wherein three partition panels among the plurality of partition panels are sized to be approximately same length as at least one of the plurality of side panels and are configured to be partially conformal with the at least one of the plurality of side panels.

2. The container of claim 1, wherein the plurality of side panels include at least a first side panel, a second side panel, a third side panel, and a fourth side panel foldably connected together at vertical side fold lines.

3. The container of claim 2, wherein the plurality of side panels include only the first, second, third, and fourth side panels, wherein the first side panel is connected to the fourth side panel to form a box.

4. The container of claim 1, wherein the inner partition member includes a plurality of partition panels foldably connected together at vertical partition fold lines.

5. The container of claim 1, wherein the inner partition member includes a first, second, third, fourth, fifth, sixth, and seventh partition panels.

6. The container of claim 5, wherein the partition panels are equally sized and shaped.

7. The container of claim 6, wherein the first and third side panels are sized to be the about the same length as the three partition panels, the second and fourth side panels are sized such that two partition panels are configured to extend across the interior space from the third side panel to the first side panel.

8. The container of claim 7, wherein the fourth partition panel is adhered to a middle of the interior surface of the third side panel or second side panel such that the first, second, third, fifth, sixth, and seventh partition panels are configured to move relative to the fourth partition panel and the third side panel or second side panel.

9. The container of claim 8, wherein the second position is a partially partitioned position, wherein the third partition panel and the second partition panel are folded relative to the fourth partition panel to extend across the interior space such that the first panel is in flush contact with the opposing side wall, or wherein the fifth partition panel and the sixth partition panel are folded relative to the fourth partition panel to extend across the interior space such that the sixth panel is in flush contact with the opposing side wall.

10. The container of claim 9, wherein the second position is a fully partitioned position wherein the third partition panel and the second partition panel are folded relative to the fourth partition panel to extend across the interior space such that the first panel is in flush contact with the opposing side wall, and wherein the fifth partition panel and the sixth partition panel are folded relative to the fourth partition panel to extend across the interior space such that the sixth panel is in flush contact with the opposing side wall.

11. A blank arrangement, comprising:

a first blank having a plurality of side panels foldably connected together and configured to define an interior space; and a second blank comprising a plurality of partition panels foldably connected together, wherein only a single partition panel is adhered to an attachment panel of the plurality of side panels, wherein three partition panels among the plurality of partition panels are sized to be approximately same length as at least one of the plurality of side panels and are configured to be partially conformal with the at least one of the plurality of side panels.

12. The blank arrangement of claim 11, wherein only a middle panel or plurality of middle panels of the plurality of partition panels are adhered to attachment panel.

13. The blank arrangement of claim 12, wherein the plurality of side panels includes a first, second, third, and fourth side panel, wherein the plurality of partition panels include a first, second, third, fourth, fifth, sixth, and seventh partition panel.

14. The blank arrangement of claim 13, wherein the fourth partition panel is adhered to a middle of the third side panel such that there are an equal number of moveable partition panels on each side of the fourth side panel.

15. The blank arrangement of claim 11, wherein the second blank lays completely within edges of the first blank.

16. The blank arrangement of claim 13, wherein the second blank extends over only the second, third, and fourth side panels.

17. The blank arrangement of claim 11, wherein the partition panels are equally sized and shaped.

18. The blank arrangement of claim 17, wherein the first and third side panels are sized to be the about the same length as the three partition panels, the second and fourth side panels are sized such that two partition panels are configured to extend across the interior space from the third side panel to the first side panel.

19. The blank arrangement of claim 11, wherein the partition panels are about the same height as the side panels.

20. The container of claim 11, wherein the partition panels are less than the height of the side panels.

* * * * *